US005769518A

United States Patent [19]

Grabher

[11] Patent Number: 5,769,518

[45] Date of Patent: Jun. 23, 1998

[54] PULLOUT ASSEMBLY FOR DRAWERS

[75] Inventor: Karl-Heinz Grabher, Lustenau, Austria

[73] Assignee: Alfit Aktiengesellschaft, Götzis, Austria

[21] Appl. No.: 816,757

[22] Filed: Mar. 7, 1997

Related U.S. Application Data

[63] Continuation of Ser. No. 499,033, Jul. 6, 1995, abandoned.

[30] Foreign Application Priority Data

Jul. 7, 1994 [AT] Austria ..... 1342/94

[51] Int. Cl.[6] ..... A47B 88/00

[52] U.S. Cl. ..... 312/334.6; 312/334.12; 312/334.15

[58] Field of Search ..... 312/334.9, 334.12, 312/334.13, 334.33, 334.6, 334.7, 334.8, 334.14, 334.15, 334.18, 334.27, 334.29, 334.39; 384/19

[56] References Cited

U.S. PATENT DOCUMENTS

| | | | |
|---|---|---|---|
| 4,659,237 | 4/1987 | Rapp | 384/19 |
| 4,952,074 | 8/1990 | Rock | 384/19 |
| 4,955,160 | 9/1990 | Rock | 312/334.8 |
| 5,056,879 | 10/1991 | Rock et al. | 312/334.27 |

FOREIGN PATENT DOCUMENTS

| | | | |
|---|---|---|---|
| 3323195 | 1/1985 | Germany | 312/334.33 |
| 3921858 | 1/1991 | Germany | 312/330.1 |
| 42 41 832 | 6/1993 | Germany . | |

*Primary Examiner*—Peter M. Cuomo
*Assistant Examiner*—Janet M. Wilkens
*Attorney, Agent, or Firm*—Collard & Roe, P.C.

[57] ABSTRACT

In a complete pullout assembly for drawers (2, 3), with a stationary cabinet slide member (16), an intermediate slide member (10) and a drawer slide member (6), the intermediate slide member (10) being guided along the cabinet slide member (16) and the drawer slide member (6) being guided along the intermediate slide member (10), a space-saving, simple construction is obtained with the intermediate slide member (10) and the drawer slide member (6) being shaped as bottom-guiding slide members with a trough or tubular profile which is at least partially open downwardly and has a flat upper web, the intermediate slide member (10) being guided exclusively in the drawer slide member (6) with a small gap between the flat upper web thereof and the web of the drawer slide member (6) by rollers (13) rotatable about horizonal axes on side flanges thereof along which the drawer slide member (6) is guided with its upper web on both sides and along guides (8) inwardly bent from the side flanges. Intermediate slide member (1) and drawer slide member (6) have at least approximately the same profile heights.

4 Claims, 2 Drawing Sheets

PULLOUT ASSEMBLY FOR DRAWERS

This is a continuation Ser. No. 08/499,033 filed Jul. 6, 1995 now abandoned.

BACKGROUND OF THE INVENTION

The invention relates to a complete pullout assembly for a drawer slidable in a cabinet, which comprises a stationary cabinet slide member affixed to the cabinet, an intermediate slide member having a tubular profile and comprising a flat upper web and two side flanges extending downwardly from the flat upper web, the intermediate slide member having an opening between the side flanges opposite the flat upper web, the cabinet slide member extending from the cabinet to below the opening in the intermediate slide member, and an upright flange of the cabinet slide member extending into the opening and carrying a bent guide for guiding the intermediate slide member along the cabinet slide member, a drawer slide member affixed to the drawer having a tubular profile and comprising a flat upper web and two side flanges extending downwardly from the flat upper web, and guide rollers for guiding the drawer slide member along the intermediate slide member.

DESCRIPTION OF THE PRIOR ART

Compared to simple drawer slides, which consist only of a cabinet slide member and a drawer slide member, and which therefore make access to the rear part of the drawer, which remains in the cabinet, difficult because the necessary overlapping of the two slide members causes a loss in the pullout path, complete pullout assemblies have the fundamental advantage that they make possible a guided complete pullout of the drawer with an arrangement of an intermediate slide member which provides a so-called additional pullout.

A complete pullout assembly of the first-described type is known from published German patent application No. 4,241,832. In the known pullout assembly, roller carriages spaced along the intermediate slide member and mounted thereon by being clamped or screwed to the intermediate slide member are provided to guide the drawer slide member, the roller carriages comprising, on top, adjacent rollers rotating about vertical axes and engaging the insides of lateral flanges on the drawer slide member, and guide rollers spaced therefrom on side flanges and rotating about horizontal axes, the guide rollers engaging the inside of a web of the drawer slide member extending thereabove, and the drawer slide member further comprising a lower, bent-over support flange for one inwardly directed roller while the second roller is supported exclusively on top.

This structure requires the rollers rotating about vertical axes to impart to the guidance a sufficient lateral stability to prevent jamming. These rollers, which are rotatable about vertical axes, have to be mounted in the gap between the intermediate and drawer slide members, and the guide cages of the roller carriages result in a substantial distance of the upper side of the intermediate slide member from the underside of the drawer slide member and thus, in totality, a relatively great structural height of the complete pullout assembly, compared to comparable simple drawer slides.

SUMMARY OF THE INVENTION

It is an object of the invention to provide a complete pullout assembly of the first-described type which, compared to known constructions, requires little space, particularly a substantially reduced structural height, makes a simple assembly possible and still can be mounted in a covered manner. It is also an object of the invention to provide a complete pullout assembly in which mass-produced parts of a bottom-guiding simple drawer slide may be used directly or in a slightly modified form, which can be mounted with the same fastening elements as a below-level simple drawer slide and which has only an insignificantly greater structural height than such a below-level simple drawer slide.

The main object is accomplished by a complete pullout assembly for a drawer slidable in a cabinet, which comprises a stationary cabinet slide member affixed to the cabinet, an intermediate slide member and a drawer slide member affixed to the drawer. The cabinet slide member has an upright flange. The intermediate slide member has a tubular profile and comprises a flat upper web and two side flanges extending downwardly from the flat upper web, the intermediate slide member having an opening between the side flanges opposite the flat upper web. The cabinet slide member extends from the cabinet to below the opening in the intermediate slide member, and the upright flange of the cabinet slide member extends into the opening and carries a bent guide for guiding the intermediate slide member along the cabinet slide member. The drawer slide member has a tubular profile and comprises a flat upper web and two side flanges extending downwardly from the flat upper web and having inwardly bent guide paths for guiding the drawer slide member along the intermediate slide member, the guide paths defining an opening therebetween opposite the flat upper web, the flat upper webs of the intermediate slide member and the drawer slide members defining a small gap therebetween, and the intermediate slide member and the drawer slide member having at least approximately the same height. Guide rollers are arranged on the side flanges of the intermediate slide member and are guided along the flat upper web and the guide paths of the drawer slide member.

The invention enables the required below-level assembly height of the complete pullout assembly to be only a little greater than the assembly height of a comparable simple drawer slide, that is in practice, by the thickness of the web of the drawer slide member and the gap spacing, which has the consequence that the same measurements of the drawer and of the cabinet height are possible for simple drawer slides and complete pullout assemblies. Only a small distance is necessary between the side wall or frame of the drawer and the side wall of the cabinet. Since both rollers are in guiding engagement with the drawer slide member on top and on the bottom, there is a symmetrical force transmission so that jamming and difficult displacement is avoided, the rollers rotating about vertical axes required in the known construction no longer being needed. A dependable guidance is also obtained in the rear region of the drawer slide member. It is possible to provide known stops which determine the sequencing of the intermediate and drawer slide members and, furthermore, inlet bevels may be provided on the intermediate slide member to assure an automatic retraction of the drawer. It is also possible to provide detachable fastenings between the drawer slide member and the drawer, as they are known from simple drawer slides, which enable the drawer to be removed while the entire guide mechanism remains in the cabinet.

The simple drawer slide, which may be used as such, and the simple drawer slide complemented to form a complete pullout assembly differ here only in that fastening means must be provided on the drawer in the simple drawer slide for the intermediate slide member which then forms the drawer slide member, and for the complete pullout, the bearings for the rollers serving to guide the drawer slide member must be mounted on this slide member. In both instances, the same basic profile is used. The bearings for the rollers may be so prepared that openings are stamped out in the side flanges of the slide member from the inside to the outside, and the material of the stamped-out opening is shaped into a hollow bearing pin which merges integrally into the side flange.

DETAILED DESCRIPTION OF THE PREFERRED EMBODIMENT

Figure 1:
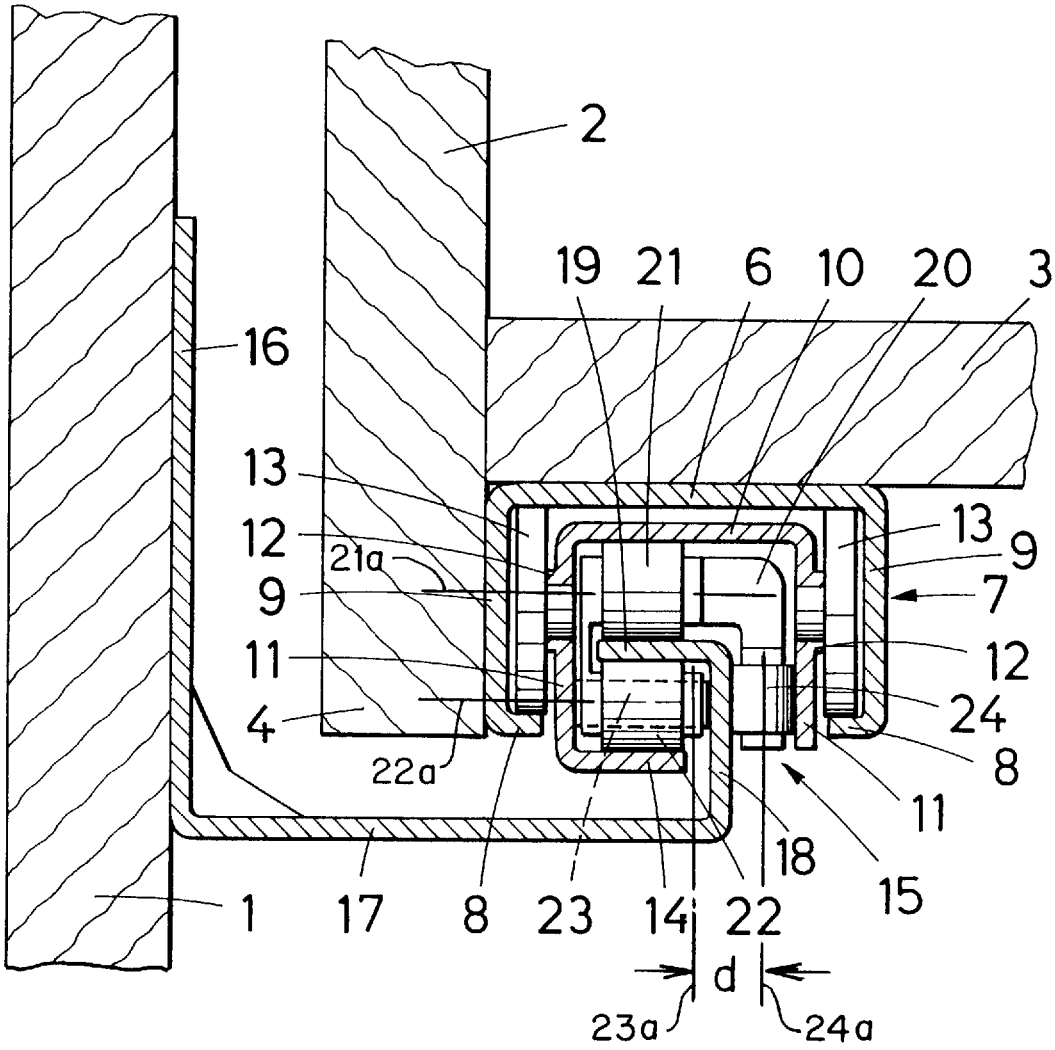
FIG. 1 shows a fragmentary sectional view of a drawer inserted in a cabinet and equipped with a complete pullout assembly according to the invention.

Only a cabinet wall 1, side wall 2 of a drawer and bottom 3 of the drawer are shown of a piece of furniture, bottom 3 being disposed a short distance from end 4 of the side wall. Drawer slide member 6 of a complete pullout assembly 7 is affixed to the drawer bottom and/or to part 4 of side wall 2 adjacent each side wall 2. This drawer slide member 6 has a U-shaped profile which is downwardly open, lower rims 8 of side flanges 9 being inwardly bent to define guide paths.

An intermediate slide member 10 of the complete pullout assembly is guided in drawer slide member 6, only a small gap being defined between the upper web of intermediate slide member 10 and the upper web of the drawer slide member. For guidance, side flanges 11 of intermediate slide member 10 have outwardly stamped hollow axles 12 bearing rollers 13, which are guided by the upper web of the drawer slide member and the guide paths provided by parts 8. Rims 8 extend close to the side flanges of slide member 10. Slide member 10 itself has a tubular profile whose lower web 14 ends at a distance from opposite side flange 11 so that an opening 15 is formed.

Cabinet slide member 16 has an angle profile one of whose leg is affixed to cabinet wall 1 and whose other leg 17 reaches below opening 15. Bent flange 18 extends from the end of leg into the opening and guide 19 is bent from flange 18. Roller carriage 20 is arranged in the cavity defined by intermediate slide member 10, rollers 21, 22 support it on the upper web and lower web 14 of intermediate slide member 10 and on guide 19, and the roller carriage has further rollers 23, 24 which guide it along flange 18 and the side flanges of intermediate slide member 10.

Figure 2:
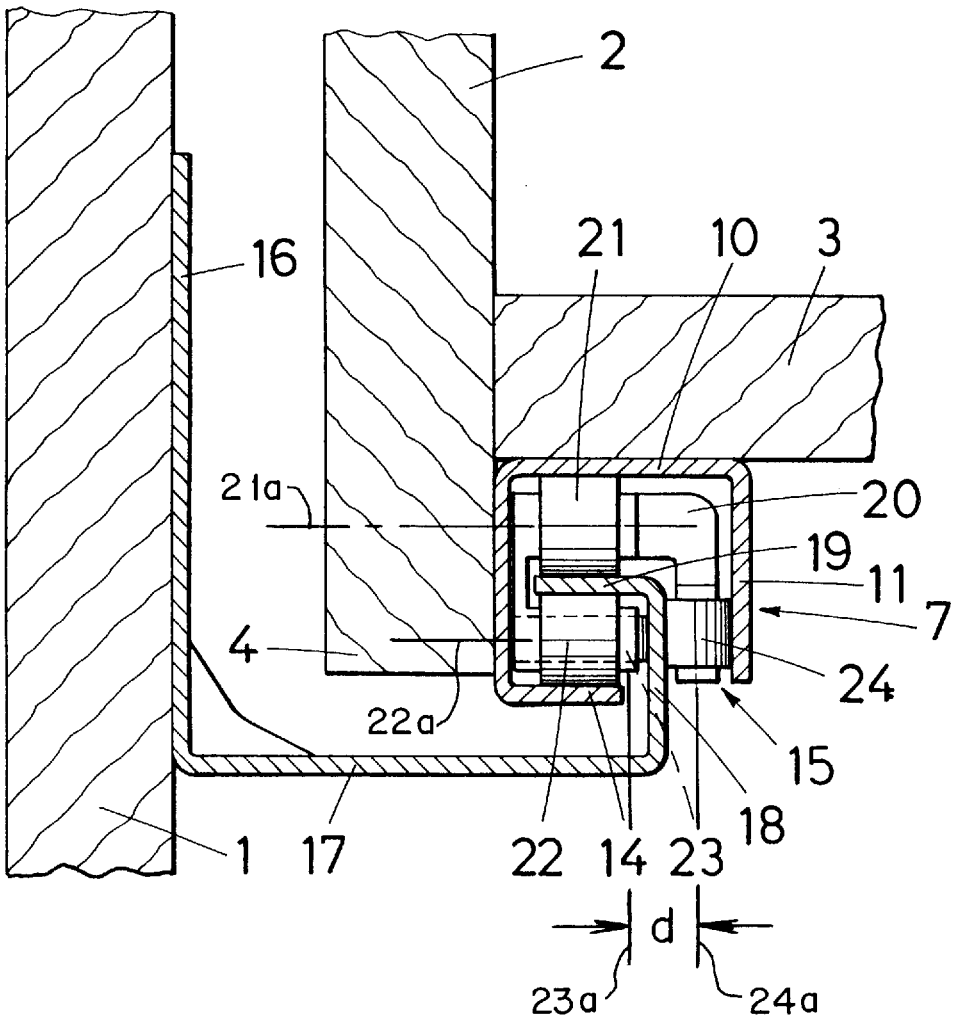
FIG. 2 is a like view illustrating a simple drawer slide readily convertible into the complete pullout assembly of FIG. 1.

If, as shown in FIG. 2, axles 12 and rollers 13 are omitted, cabinet slide member intermediate slide member 10 and roller carriage 20 with its rollers 21–24 form a simple drawer slide, in which the intermediate slide member of the complete pullout assembly becomes the drawer slide member and is affixed to the drawer.

FIGS. 1 and 2 show the following. There are four guide rollers, with a first guide roller 21 having a horizontal axis of rotation 21*a*, a second guide roller 22 below said first guide roller 21 and having a horizontal axis of rotation 22*a*, a third guide roller 23 carried by said second guide roller 22 and having a vertical axis of rotation 23*a* and a fourth guide roller 24 a horizontal distance "d" from said third guide roller 23 and having a vertical axis of rotation 24*a;* said third guide roller 23 and said fourth guide roller 24 in simultaneous roller contact with said upright flange 18 on an opposite side of said upright flange 18; and said first guide roller 21 and said second guide roller 22 in simultaneous roller contact with said bent guide 19 with said first guide roller 21 above said bent guide 19 and with said second guide roller 22 below said bent guide 19.

I claim:

1. A complete pullout assembly for a drawer slidable in a cabinet, which comprises (a) a stationary cabinet slide member adapted to be affixed to the cabinet, the cabinet slide member having
  (1) an upright flange, (b) an intermediate slide member having a tubular profile and comprising
  (1) a flat upper web, and
  (2) two side flanges extending downwardly from the flat upper web,
  (3) the intermediate slide member having an opening between the side flanges opposite the flat upper web,
  (4) the cabinet slide member is adapted to extend from the cabinet to below the opening to the intermediate slide member, and the upright flange of the cabinet slide member extending into the opening and carrying a bent guide for guiding the intermediate slide member along the cabinet slide member, (c) a drawer slide member adapted to be affixed to the drawer having a tubular profile and comprising
  (1) a flat upper web and
  (2) two side flanges extending downwardly from the flat upper web and having inwardly bent guide paths for guiding the drawer slide member along the intermediate slide member, the guide paths defining an opening therebetween opposite the flat upper web,
  (3) the flat upper webs of the intermediate slide member and the drawer slide members defining a small gap therebetween, and
  (4) the intermediate slide member and the drawer slide member having at least approximately the same height, and (d) four guide rollers, with a first guide roller having a horizontal axis of rotation, a second guide roller below said first guide roller and having a horizontal axis of rotation, a third guide roller carried by said second guide roller and having a vertical axis of rotation, and a fourth guide roller a horizontal distance from said third guide roller and having a vertical axis of rotation;

said third guide roller and said fourth guide roller in simultaneous roller contact with said upright flange on opposite sides of said upright flange; and said first guide roller and said second guide roller in simultaneous roller contact with said bent guide with said first guide roller above said bent guide and with said second guide roller below said bent guide.

2. The complete pullout assembly as claimed in claim 1, wherein in (c)(2), the drawer slide member with the inwardly bent guide paths is guided on bearing rollers arranged outside of the immediate slide member, and said bearing rollers also being guided on the upper web of the drawer slide member.

3. A complete pullout assembly for a drawer slidable in a cabinet, which comprises (a) a stationary cabinet slide member adapted to be affixed to the cabinet, the cabinet slide member having
  (1) an upright flange, (b) an intermediate slide member having a tubular profile and comprising
  (1) a flat upper web, and
  (2) two side flanges extending downwardly from the flat upper web, (3) the intermediate slide member having an opening between the side flanges opposite the flat upper web, (4) the cabinet slide member is adapted to extend from the cabinet to below the opening to the intermediate slide member, and the upright flange of the cabinet slide member extending into the opening and carrying a bent guide for guiding the intermediate slide member along the cabinet slide member, (c) a drawer slide member adapted to be affixed to the drawer having a tubular profile and comprising (1) a flat upper web and (2) two side flanges extending downwardly from the flat upper web and having inwardly bent guide paths for guiding the drawer slide member along the intermediate slide member, the guide paths defining an opening therebetween opposite the flat upper web, (3) the flat upper webs of the intermediate slide member and the drawer slide members defining a small gap therebetween, and (4) the intermediate slide member and the drawer slide member having at least approximately the same height, and (d) four guide rollers, with a first guide roller having a horizontal axis of rotation, a second guide roller below said first guide roller and having a horizontal axis of rotation, a third guide roller carried by a roller carriage and having a vertical axis of rotation, and a fourth guide roller a horizontal distance from said third guide roller and having a vertical axis of rotation;

said third guide roller and said fourth guide roller in simultaneous roller contact with said upright flange on opposite sides of said upright flange; and said first guide roller and said second guide roller in simultaneous roller contact with said bent guide with said first guide roller above said bent guide and with said second guide roller below said bent guide.

4. The complete pullout assembly as claimed in claim 3, wherein in (c)(2), the drawer slide member with the inwardly bent guide paths is guided on bearing rollers arranged outside of the immediate slide member, and said bearing rollers also being guided on the upper web of the drawer slide member.

* * * * *